United States Patent [19]

Wedman

[11] Patent Number: 4,861,023

[45] Date of Patent: Aug. 29, 1989

[54] LEG MUSCLE EXERCISE DEVICE AND METHOD

[76] Inventor: Mike Wedman, 2920 Sixth St., Boulder, Colo. 80302

[21] Appl. No.: 80,490

[22] Filed: Jul. 31, 1987

[51] Int. Cl.[4] ..... A63B 21/00

[52] U.S. Cl. ..... 272/120; 272/903; 272/109

[58] Field of Search ..... 272/61, 63, 70, 93, 272/85, 87, 92, 73, 109, 120, 121, 144, 146, 903

[56] References Cited

U.S. PATENT DOCUMENTS

| | | | |
|---|---|---|---|
| 859,212 | 7/1907 | Gerthoffer | 272/92 |
| 1,142,137 | 6/1915 | Bathrick | 272/109 |
| 3,235,256 | 2/1966 | Grudoski | 272/87 |
| 3,510,128 | 5/1970 | Richardson | 272/73 |
| 3,580,569 | 5/1971 | Wilson | 272/70.3 |
| 3,584,871 | 6/1971 | Kelmon | 272/146 |
| 3,734,494 | 5/1973 | Sellner | 272/144 |
| 3,756,595 | 9/1973 | Hague | 272/70 |
| 3,784,194 | 1/1974 | Perrine | 272/125 |
| 3,896,798 | 7/1975 | Simon | 272/63 |
| 4,046,373 | 9/1977 | Kim | 272/63 |
| 4,132,404 | 1/1979 | Wilson | 272/109 |
| 4,226,415 | 10/1980 | Wright | 272/130 |
| 4,456,247 | 6/1984 | Ehrenfried | 272/126 |
| 4,478,411 | 10/1984 | Baldwin | 272/118 |
| 4,544,153 | 10/1985 | Babcock | 272/97 |
| 4,550,908 | 11/1985 | Dixon | 272/130 |

FOREIGN PATENT DOCUMENTS 3209353 9/1983 Fed. Rep. of Germany ..... 272/120

OTHER PUBLICATIONS

The Frame Advertisement, Home Gym & Fitness Magazine.

Power Stretch Advertisement, Home Gym & Fitness Magazine.

Fitness Master Advertisement, Home and Gym & Fitness Magazine, Nov. 1986, p. 85.

Paramount Computer Fitness System Advertisement, Home Gym & Fitness Magazine.

*Primary Examiner*—Steven A. Bratlie

*Assistant Examiner*—J. Welsh

*Attorney, Agent, or Firm*—Oblon, Fisher, Spivak, McClelland & Maier

[57] ABSTRACT

An exercise device for muscle conditioning of an individual in an upright position, which includes a frame having a first and second rail, a first and second pedal stem connected to said first and second rail, respectively; a pedal connected to an end portion of each of the first and second pedal stems and upon which the feet of the individual are placed; and a mechanism mounted on the frame for pivotally connecting at least the first pedal stem to the first hand rail so as to allow for movement of the at least first pedal stem toward and away from the second pedal stem for conditioning the muscles of the individual in the upright position.

16 Claims, 6 Drawing Sheets

LEG MUSCLE EXERCISE DEVICE AND METHOD

BACKGROUND OF THE INVENTION

1. Field of the Invention

This invention relates to exercise devices and a method for providing over-all body conditioning, and more particularly to leg strengthening and stretching devices and methods.

2. Description of the Prior Art

It has long been recognized in the field of exercise physiology, that flexibility of the leg muscles, as well as mobility of the hip joint, are important requisites in sports such as gymnastics, dancing and martial arts. Further, a wide variety of stretching exercises have long been developed and prescribed as preventatives for strained or torn muscle injuries. It is also increasingly recognized that improving leg flexibility helps to increase stride length and hence the speed of a runner. Stretching the leg muscles and increasing their flexibility is now considered an essential part of the training regimen of virtually all vigorous sports.

There are several devices on the market designed to facilitate various leg stretching exercises. One genre of these devices, (i.e., U.S. Pat. No. 4,456,247) places the exerciser in a seated position and, by means of a hand operated winch and cable, the legs are drawn apart to the maximum range of motion (known in the field as the "splits" position). One disadvantage of these devices is that they deal primarily with stretching the leg adductor muscles only. Also, the seated position does not simulate the joint and muscle alignment and upright body position which an athlete would normally assume while engaged in most sports activities.

In another type of device, (i.e., U.S. Pat. Nos. 3,584,871, 4,046,373 and 3,132,404) the exerciser places his or her feet on separate platforms which have means for rolling or sliding apart until the exerciser is in the splits position. Some of these devices have no means for the exerciser to support or balance himself or herself and could be quite hazardous. Also, since it is necessary, in order to increase one's flexibility, to work at the outer limits of one's range of motion, with the platforms of this device fully separated, only the very strong athlete can lift his or her full body weight in the fashion required to slide the platforms back to their starting positions. Hence again these devices and intended exercises could be hazardous or impossible for novice or developing athletes to perform. Finally, since the platforms follow a horizontal plane through the range of motion, the exerciser's feet are forced into uncomfortable positions, creating stress at the balls of the feet, heels and ankles.

SUMMARY OF THE INVENTION

Therefore, due to these and other disadvantages of the prior art it is an object of the present invention to provide:

1. Means for stretching and contracting leg muscle groups including the adductors, abductors, hamstrings, quadriceps, hip flexors and gluteus muscles.

2. Means for performing these leg exercises while in the upright, standing position.

3. A padded frame by which the exerciser may be supported and balanced while exercising.

4. Means for performing a variety of upper body exercises upon said frame (e.g., dips, inverted pullups, etc.).

5. Foot supports or pedals attached to and suspended by stems from this frame. These stems may be rigid like tubing, or flexible like cable.

6. Means for allowing the pedal stem to pivot relative to the frame. The means by which pivoting may be accomplished is understood in the broadest sense. The figures show examples of stems which move within a single plane, but multi-pane pivots and non-planar (e.g., ball and socket) pivots are understood to be part of the present invention.

7. Pedals which pivot relative to the stem allowing exerciser's feet to assume a comfortable position throughout the range of motion. This pivot is similar to the manner in which a bicycle pedal works.

8. Means for indexing pedal direction or orientation relative to the longitudinal axis of the pedal stem or relative to the frame. The angle at which the feet are pointing relative to the plane of motion determines which muscle groups are being affected. See FIGS. 2–5. When the feet are in line with the plane of motion the quadriceps and hamstrings are being used whereas when the feet are at 90°, the adductors/abductors are used.

9. Means for applying and adjusting resistance to the pivoting motion of the pedal stems, which the exerciser's leg muscles work against. This resistance is either balanced between, or applied equally to, the pedal stems. This resistance can be positive, isotonic, isokinetic, variable or iso-metric in nature.

10. Means for easily folding-up or "knocking-down" the entire apparatus for shipping or storage purposes.

In accordance with the present invention, an exercise device is provided for muscle conditioning of an individual in an upright position, comprising, a frame having a first and second parallel, horizontally oriented hand rail, a first and second pedal stem connected to said first and second rails, respectively, a pedal connected to an end portion of each of said first and second pedal stems and upon which the feet of the individual are placed, and means mounted on said frame for pivotally connecting at least said first pedal stem to said first rail so as to allow for movement of said at least first pedal stem towards and away from said second pedal stem for conditioning of the muscles of the individual in said upright position.

A method of exercising leg muscles is also disclosed, which method includes the process of exercising leg muscles of an individual in an upright position by use of a frame having a first and second parallel, horizontally oriented hand rail; a first and second pedal stem connected to the first and second rails, respectively; a pedal connected to an end portion of each of the first and second pedal stems; and means mounted on the frame for pivotally connecting at least the first and second pedal stems to the first and second rails, wherein said method comprises supporting the feet of the individual, respectively, on each pedal connected to an end portion of each of the first and second pedal stems while the individual is in an upright position; pivoting the pedals apart so as to flex the leg muscles of the individual and lower the individual; and drawing the pedals towards one another so as to raise the individual.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DESCRIPTION OF THE PREFERRED EMBODIMENTS

Figure 1:
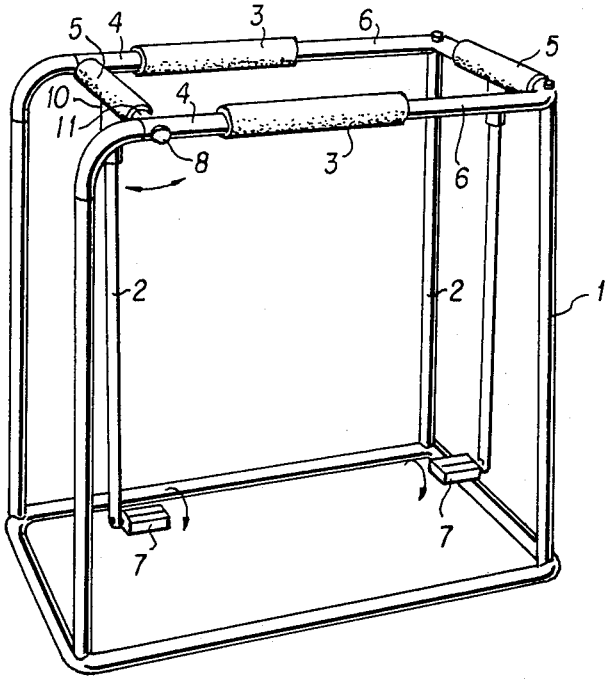
FIG. 1 shows a perspective view of one preferred embodiment.
Figure 9:
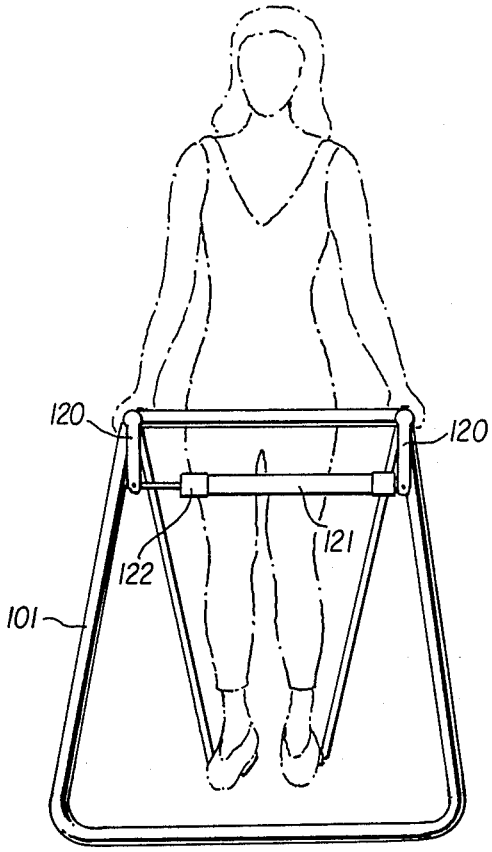
FIG. 9 illustrates an embodiment utilizing a single adjustable cylinder for resistance.
Figure 10:
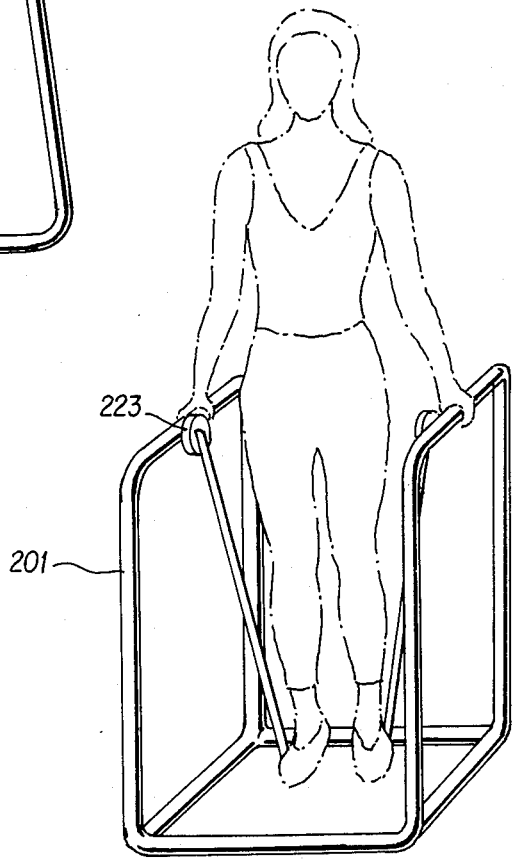
FIG. 10 shows an embodiment showing an arrangement for allowing the feet of the person exercising to pass by each other at the center to perform a walking or striding motion and wherein resistance occurs at the pivot point through an adjustable rotary dashpot or actuator.
Figure 11:
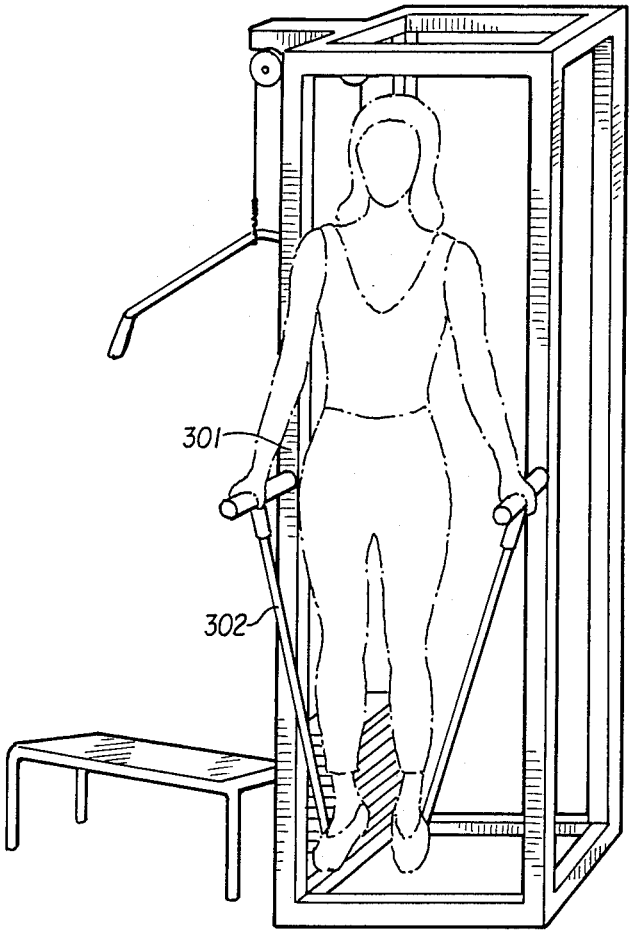
FIG. 11 illustrates an embodiment showing the framework of multi-station exercise device for supporting and incorporating the present invention.

FIG. 1 illustrates a perspective view of one preferred embodiment. In this embodiment a rectangular box-shaped frame 1 is used to support and suspend two separate pedal stems 2 along the longitudinal axis of the frame. Any framework from which two pedal stems may be suspended and which allows the exerciser to balance and support himself could be used. The manner in which exercise is performed is illustrated in FIGS. 2–5. Other examples of preferred embodiments are shown in FIGS. 9, 10 and 11, which shows frames 101, 201 and 301, respectively. The framework could function solely as a support for the present invention or could have additional uses as well, e.g., the frame 201 in FIG. 10 could also serve as hand rails for a tread mill. In addition, the pedal stems could be attached to and suspended from ordinary gymnastic parallel bars or the like. Or as illustrated in FIG. 11, pedal stems 302 could be supported by the framework 301 of a multi-station exercise device, examples of which are well known in the field.

Figure 5:
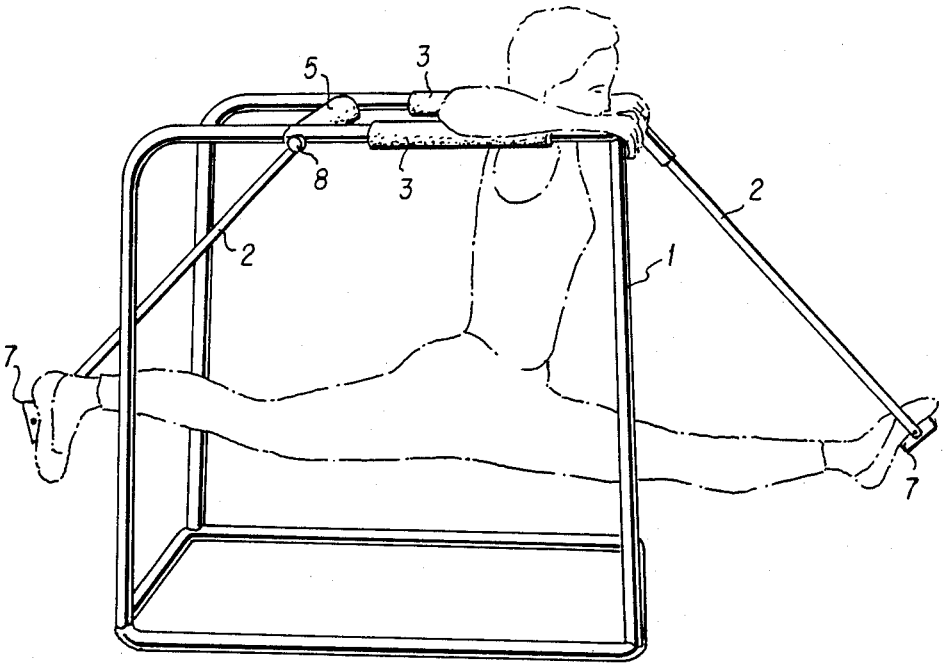
FIG. 5 illustrates the same foot position as in FIG. 4, but shown here at the bottom of the range of motion.

As shown in FIG. 5, provided on the upper portion of the frame are pads 3, 5 which serve as protection should the exerciser accidentally lose balance. These pads 3, 5 also serve as non-slip hand grips or hand rails and nylon bearings 15 can be utilized. Additional features of the frame 1 may include leveling screws (not shown) located on bottom side of frame adjustable to give the frame firm support and protect floor surfaces. It is also understood that by using means common in the field of manufacturing exercise equipment, the frame can be made to fold-up or be easily assembled and disassembled for shipping or storage purposes.

Figure 7:
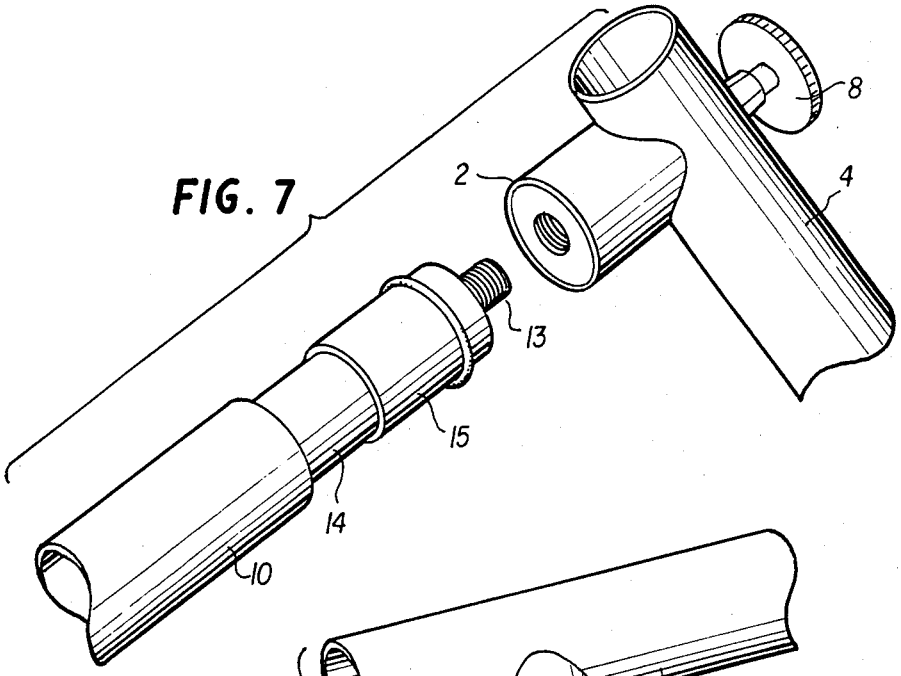
FIG. 7 shows an exploded view of FIG. 6 showing the nylon bearing.

Looking again at FIG. 1, means are provided for the pedal stems 2 to pivot relative to the frame 1. In FIG. 7 one means of providing the pivoting movement is illustrated. The upper T-shaped end of an upper pedal stem 10 is a section of steel tubing which fits within recommended tolerances, around the outer diameter of an additional nylon-type bearing 15. The inner-diameter of bearing 15 fits the outer diameter of the steel tubing end rail 14. A threaded stud 13 is welded at both ends of the end rail 14. A weld-nut 12 is provided integral to the supporting frame, such that when joined to welded stud 13, such supports and suspends the pedal stem 2. This configuration allows the pedal stems 2 to pivot freely in a plane of motion perpendicular to the end rails 14 and perpendicular to pads or hand rails 5,5. Since the two end rails 14 provided (i.e. one inside each pedal stem 2) are generally parallel, both pedal stems 2 pivot within the same plane of motion. Limiting the pedal stem movement to one plane provides the exerciser a degree of stability and balance. Such also allows repeated engagement and isolation of a specific muscle group. It is understood that other means of pivoting which allow movement in more than one plane would be possible, e.g. a vertically suspended ball and socket pivot.

Returning again to FIG. 1, also provided are foot supports or pedals 7 which the exerciser places his or her feet upon. These pedals 7 are affixed to the lower end of the pedal stems 2 and means are provided so that they may spin freely in a manner similar to a bicycle pedal and its attachment to the pedal crank. Other embodiments of the pedal configuration would allow including straps or stirrups to further secure the exerciser's feet to the pedals. The rotating action of the pedal 7 allows the feet to maintain a comfortable position throughout the range of motion. This rotating pedal feature also allows the exerciser to contract or relax the gastronomic and other muscles of the shin and ankle region, independently from the muscles of the upper leg.

To use the device, the exerciser first steps inside of the supportive framework 1. Next, placing both hands on either hand-rails 3 or 5 for support and balance, the exerciser places his or her feet, one at a time, upon pedals 7 so as to be supported thereby. As the exerciser's weight is allowed to bear on the pedals 7 they are caused to pivot or rotate apart—outwardly as far as the flexibility of the leg muscles allow as seen in FIGS. 3 and 5. By holding this outer or lower position, the exerciser will tend to stretch and elongate the muscle fibers. Diligent and repeated performance of this stretching movement will, over a period of time, tend to increase leg flexibility and range of motion to the point one could perform the splits. From this bottom position, it is possible by squeezing the legs together, with assistance from the arms and shoulders if necessary, to draw the pedals 7 back together and raise the body to the upper position illustrated in FIGS. 2 and 4. Diligent and repeated performance of these muscle contractions will tend to tone and strengthen the leg muscles so engaged. It can be seen that by performing a complete repetition (starting from the "top" position, lowering slowly to the "bottom" position, then by squeezing the legs together returning once again to the top position) both a stretching and a contraction of the engaged muscle group is accomplished. Finally, by undertaking a period of exercise of around 15 minutes or more, the repeated cycle of the described exercise constitutes that which is known in the field as "aerobic exercise".

Figure 8:
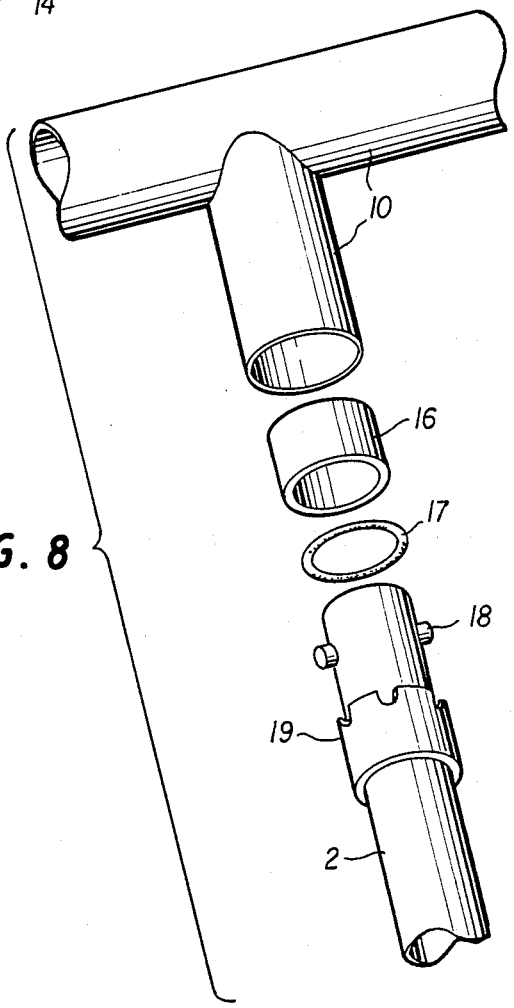
FIG. 8 shows an exploded view of the pedal indexing mechanism.

In the upper segment of the pedal stem 2, means are provided to allow indexing or radially adjusting the position of the lower portion of the pedal stem 2 relative to the longitudinal axis of the pedal stem and relative to the plane of motion. Referring to FIG. 8, one will see that the pedal stem 2 is actually two pieces, a lower pedal stem 2 and an upper pedal stem 10 which is T-shaped. The lower stem 2 is made of steel tubing which has an outer diameter smaller than the inner diameter of the tubing forming upper pedal stem 10. Two spacers 16 and 19 have a "slip-fit" tolerance with both the inner diameter of upper pedal stem 10 and the outer diameter of lower pedal stem 2, and serve the purpose of aligning the two parts. Notched spacer 19 has semi-circular notches cut into its upper edge at intervals of 45°. A steel pin 18 passes through the middle of the upper end of lower pedal stem 2 and may "seat" in any two notches which are 180° apart. A compression spring 17 is under tension between spacer 16 and steel pin 18 to ensure that the pin 18 stays seated while exercise is in progress. Spacer 16 is positioned in a vertical portion of stem 10 and abuts a horizontal portion of T-shaped pedal stem 10. The pin 18 will also stay seated, however, with the spring 17 omitted.

When assembled, the spacers 16 and spring 17 and upper end of lower pedal stem 2 are inserted into upper pedal stem 10 and the bottom edge of notched spacer 19 is welded to the bottom edge of the vertical portion upper pedal stem 10, thereby forming an indexable support of the lower pedal stem 2. To index the pedal 7, one lifts up on the lower pedal stem 2 until the steel pin 18 clears the notches in notched spacer 19 at which point the lower pedal stem 2 can be rotated and lowered into a different pair of notches.

Figure 2:
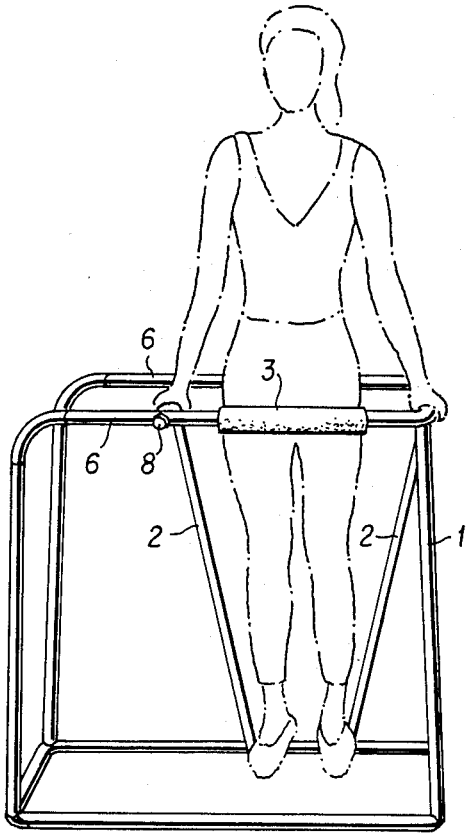
FIG. 2 discloses an exerciser in accordance with the present invention with both feet 90° relative to the plane of motion, shown at the top of the range of motion.
Figure 3:
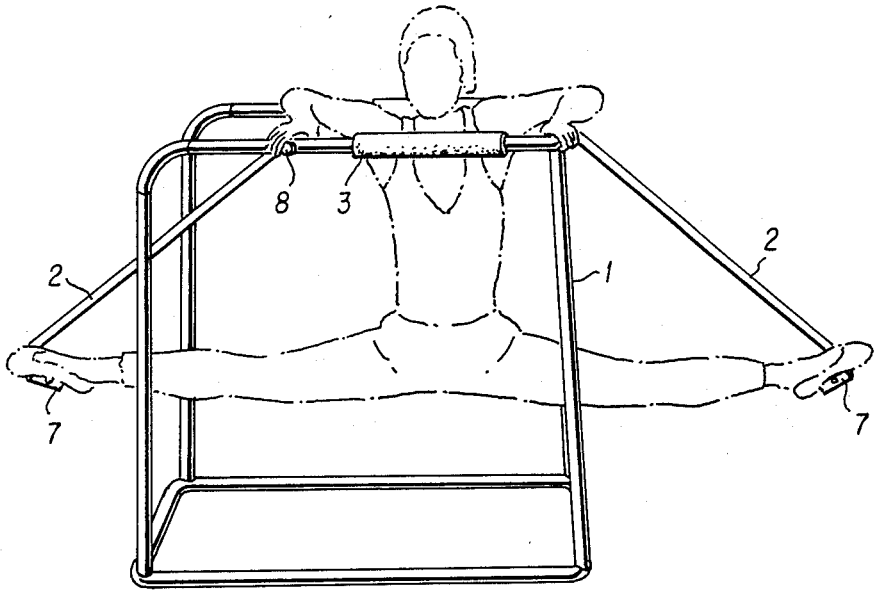
FIG. 3 shows the same foot position as shown in FIG. 2 but shown here at the bottom of the range of motion (i.e., splits position).
Figure 4:
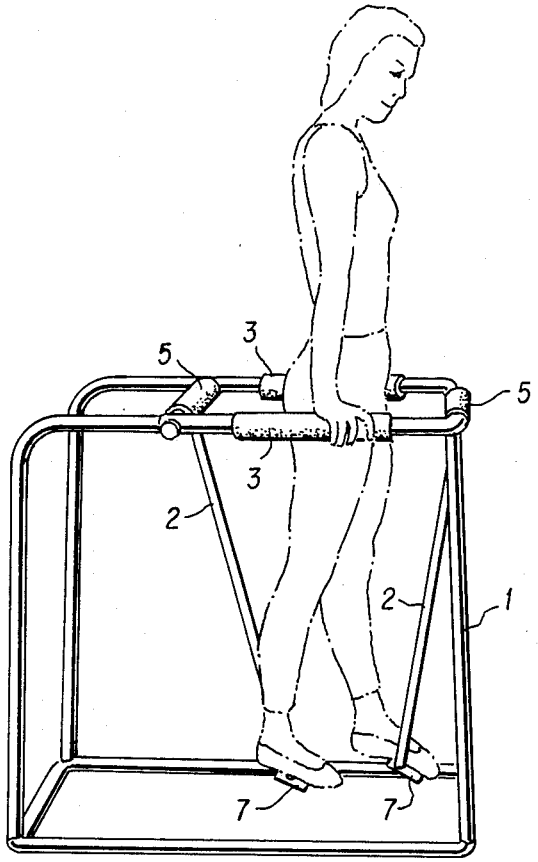
FIG. 4 shows an exerciser with both feet at 0° or in line with the plane of motion, shown here at the top of the range of motion.

FIGS. 2–5 illustrate the effect of indexing the pedals. FIGS. 2 and 3 show the exerciser's feet at 45° and 135° angle relative to the plane of motion (P.O.M.) (i.e., the plane of motion of the lower pedal stem 2 upon pivoting) followed by the pedal stems 2. In FIGS. 4 and 5 the pedals have been indexed so the feet are at 0°, or "in line" with the P.O.M. It is also possible to index the pedals 7 so that the feet are not parallel to each other (e.g. left foot forward pointed at 0° while right foot back pointed at 90°). As shown in the illustrated embodiment of FIG. 8, means are provided to index the pedal stems 2 in increments of 45°. Therefore, a variety of combinations of foot orientations relative to themselves and the P.O.M. are possible. Each combination of foot positions tends to isolate and engage different muscle groups of the upper legs and buttocks.

Resistance to pivoting motion of the pedal stems is created in the preferred embodiment (FIG. 1) by the exerciser's body weight. Means are provided allowing for an adjustment of this resistance. One of the upper pedal stems 9 is in a constant or stationary position with respect to frame 1, while the other upper pedal stem 10 is part of the sliding pedal support assembly 11. Two sliding hand rails 4 are joined by an end rail 14 as shown previously in FIG. 7. These tubular hand rails 4 have a "slip-fit" tolerance around the outer diameter of side rails 6.

Figure 6:
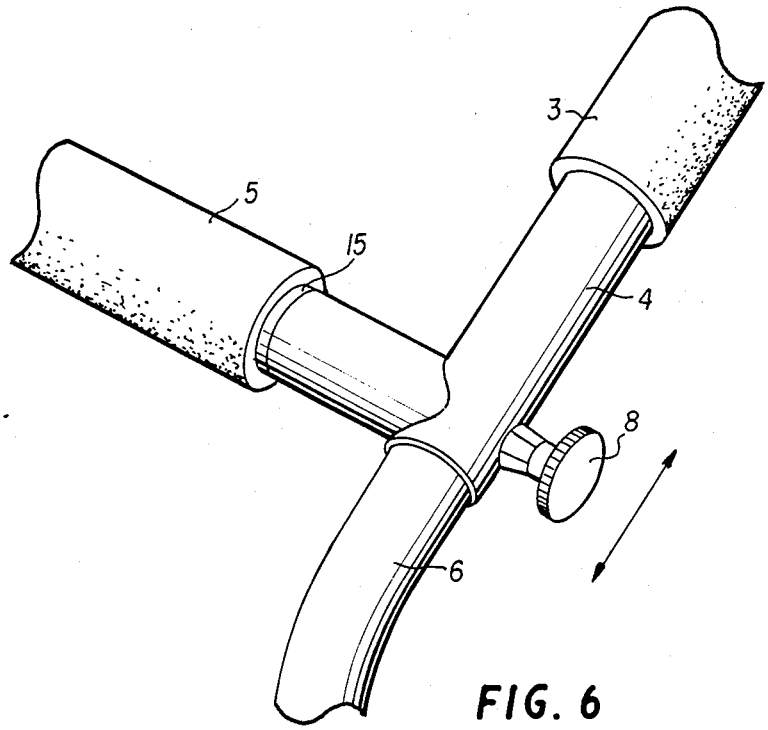
FIG. 6 illustrates an enlarged detail of a portion of the sliding pedal stem assembly.

As shown in FIG. 6, two nylon-tipped set screws with hand knobs 8, one affixed to each of hand rails 4, allow means to "lock" the sliding pedal support assembly 11 to side rails 6. By loosening the set screws 8, the assemble 11 may slide along the side rails 6 and be locked in different positions. Due to the geometry and physics involved in this assembly, the closer the sliding pedal support assembly 11 is to a pedal assembly 9 which is maintained stationary, the easier it is to perform the exercise. When the two assemblies are moved further apart, the exercise is more difficult to perform. The range of adjustment in the illustrated embodiments is approximately 20" between pivot points at the narrowest setting and approximately 36" at the widest setting. (See FIGS. 3 and 4 to compare different settings). This adjustment provides means for easily adapting the device to exercisers with significantly different levels of strength and flexibility. This adjustment also allows the individual exerciser the choice of performing many repetitions at a close setting to build endurance, or fewer repetitions at a wide setting to build strength.

While the body weight of the exerciser offers resistance in the described embodiment, it is understood that numerous other means of providing resistance are possible. This would include but not be limited to hydraulic, pneumatic, electromagnetic or mechanical devices and configurations well known in the field. It is further understood that the applied resistance could be positive, iso-tonic, iso-kinetic, iso-metric or variable in nature, definitions and examples of each being well known in the field.

Shown in FIGS. 9 and 10 are just two of many possible alternate embodiments. In FIG. 9, resistance is provided to both legs by incorporating a single closed-system adjustable hydraulic cylinder 121. This configuration would balance the resistance equally between both legs. The two ends of the cylinder are attached to lever arms 120 which are linked to the upper pedal stems. The nature and construction of the cylinder 121 is such that it resists both elongation and retraction. The level of these resistive forces can be adjusted by turning selection collar 122. This enables the exerciser to set one level of resistance to be applied to the legs moving outwards and another level applied against the legs efforts to move inwards.

In FIG. 10 an embodiment is illustrated showing a configuration utilizing either a pair of rotary actuators or rotary dashpots 223 to resist leg movement. It should be noted that FIG. 10 illustrates one embodiment where the exerciser's legs can pass each other in mid-stride.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An exercise device for leg muscle conditioning of an individual in an upright position, comprising:

a rectangular, box-shaped frame having at an upper portion thereof a first and second parallel and horizontally oriented hand rail and a third and fourth parallel and horizontally oriented hand rail interconnecting said first and second hand rails, respectively;

a first and second pedal stem mounted on said frame;

a pedal connected to an end portion of each of said first and second pedal stems and upon which the feet of the individual are placed; and means mounted on said frame for pivotally connecting said first pedal stem to said first hand rail so as to allow for movement of said first pedal stem towards and away from said second pedal stem in a single plane of motion perpendicular to said first and second hand rails along a longitudinal axis of said frame for conditioning of the leg muscles of the individual in said upright position and to allow for support of an upper portion of said individual between said third and fourth hand rail upon movement of said first pedal stem in said single plane of motion.

2. An exercise device as set forth in claim 1, further comprising means for pivotally connecting said second pedal stem to said second rail.

3. An exercise device as set forth in claim 1, further comprising means for radially adjustably positioning said pedal of said first and second pedal stems with respect to a longitudinal axis of at least said first pedal stem.

4. An exercise device as set forth in claim 3, wherein said means for radially adjustably positioning said pedal of said first and second pedal stems comprises means for radially adjusting said pedal with respect to both said first and second pedal stems.

5. An exercise device as set forth in claim 2, further comprising means for radially adjustably positioning said pedal of said first pedal stem with respect to a longitudinal axis of said first pedal stem.

6. An exercise device as set forth in claim 5, wherein said means for radially adjustably positioning said pedal of said first and second pedal stem further comprises adjusting said pedal with respect to both said first and second pedal stems.

7. An exercise device as set forth in claim 3, wherein each of said first and second pedal stems comprises an upper and lower pedal stem and wherein said means for radially adjustably positioning said pedal comprises means for radially adjustably interconnecting said lower pedal stem with said upper pedal stem of each of said first and second pedal stems.

8. An exercise device as set forth in claim 1, further comprising means for adjustably connecting one of said third and fourth hand rails to said first and second hand rails for adjusting the distance between said third and fourth hand rail.

9. An exercise device as set forth in claim 2, further comprising means for adjustably connecting one of said third and fourth hand rails to said first and second hand rails for adjusting the distance between said third and fourth hand rail.

10. An exercise device as set forth in claim 3, further comprising means for adjustably connecting one of said third and fourth hand rails to said first and second hand rails for adjusting the distance between said third and fourth hand rail.

11. An exercise device as set forth in claim 7, further comprising means for adjustably connecting one of said third and fourth hand rails to said first and second hand rails for adjusting the distance between said third and fourth hand rail.

12. An exercise device as set forth in claim 1, further comprising means connected to said frame for resisting pivoting of at least said first pedal stem.

13. An exercise device as set forth in claim 2, further comprising means connected to said frame for resisting pivoting of at least said first pedal stem.

14. An exercise device as set forth in claim 3, further comprising means connected to said frame for resisting pivoting of at least said first pedal stem.

15. An exercise device as set forth in claim 7, further comprising means connected to said frame for resisting pivoting of at least said first pedal stem.

16. A method of exercising leg muscles, which method includes exercising leg muscles of an individual in an upright position by use of a rectangular, box-shaped frame having first and second parallel and horizontally oriented hand rail and a third and fourth parallel and horizontally oriented hand rail interconnecting said first and second rails; a first and second pedal stem connected to the first and second hand rail, respectively; a pedal connected to an end portion of each of the first and second pedal stems; and means mounted on the frame for pivotally connecting at least the first and second pedal stems to the first and second hand rail, wherein said method comprises:

supporting the feet of the individual, respectively, on each pedal while the individual is in an upright position;

pivoting the pedals apart along a longitudinally axis of said frame in a single plane of motion perpendicular to said first and second hand rails so as to flex the leg muscles of the individual and lower the individual;

drawing the pedals towards one another in said single plane of motion so as to raise the individual; and supporting an upper portion of the individual between said third and fourth hand rails during pivoting of the pedals apart and drawing the pedals towards one another.

* * * * *